US008210109B1

(12) United States Patent
Dewees

(10) Patent No.: US 8,210,109 B1
(45) Date of Patent: Jul. 3, 2012

(54) PNEUMATIC ADJUSTABLE-HEIGHT TABLE

(76) Inventor: Thomas Gerret Dewees, Pleasanton, CA (US)

( * ) Notice: Subject to any disclaimer, the term of this patent is extended or adjusted under 35 U.S.C. 154(b) by 801 days.

(21) Appl. No.: 12/290,549

(22) Filed: Oct. 31, 2008

Related U.S. Application Data

(60) Provisional application No. 60/984,668, filed on Nov. 1, 2007.

(51) Int. Cl.
*A47B 9/00* (2006.01)
*F16M 11/24* (2006.01)

(52) U.S. Cl. ..... 108/147; 248/188.2

(58) Field of Classification Search ..... 108/147, 108/147.11; 248/161, 157, 422, 188.2, 295.11
See application file for complete search history.

(56) References Cited

U.S. PATENT DOCUMENTS

| | | | | |
|---|---|---|---|---|
| 3,080,835 | A | 3/1963 | Gugliemi | |
| 3,436,048 | A * | 4/1969 | Greer | 248/397 |
| 3,710,735 | A | 1/1973 | Litvinoff et al. | |
| 3,790,119 | A * | 2/1974 | Bauer | 248/562 |
| 4,101,005 | A * | 7/1978 | Fewkes | 187/275 |
| 4,183,689 | A * | 1/1980 | Wirges et al. | 403/31 |
| 4,436,007 | A | 3/1984 | Russon et al. | |
| 4,593,951 | A * | 6/1986 | Slaats et al. | 297/344.19 |
| 4,673,155 | A * | 6/1987 | Binder | 248/404 |
| 5,197,393 | A | 3/1993 | Yeakle | |
| 5,313,892 | A * | 5/1994 | Tice | 108/147 |
| 5,322,025 | A | 6/1994 | Sherman et al. | |
| 5,437,236 | A * | 8/1995 | Zeiner | 108/147 |
| 5,438,939 | A | 8/1995 | Clarke | |
| 5,513,825 | A | 5/1996 | Gutgsell | |
| 5,553,550 | A * | 9/1996 | Doyle | 108/147 |
| 5,775,234 | A * | 7/1998 | Solomon et al. | 108/147 |
| 6,032,588 | A * | 3/2000 | Williamson et al. | 108/66 |
| 6,079,786 | A * | 6/2000 | Kirkland et al. | 297/344.24 |
| 6,101,956 | A | 8/2000 | Keil | |
| 6,182,583 | B1 * | 2/2001 | Larson | 108/147 |
| 6,227,357 | B1 | 5/2001 | Brown, Sr. | |
| 6,283,047 | B1 | 9/2001 | Haller | |
| 6,343,556 | B1 | 2/2002 | Lanphear | |
| 6,378,671 | B1 | 4/2002 | Carlson | |
| 6,397,761 | B1 * | 6/2002 | Moore | 108/50.01 |
| 6,435,110 | B1 | 8/2002 | Keil | |
| 6,536,357 | B1 | 3/2003 | Hiestand | |
| 6,571,720 | B2 | 6/2003 | Moore | |
| 6,578,501 | B1 | 6/2003 | Moore | |
| 6,840,582 | B2 | 1/2005 | Burwell et al. | |
| 6,874,432 | B2 | 4/2005 | Lanphear | |
| 6,877,442 | B2 * | 4/2005 | Helle | 108/147 |
| 6,883,439 | B1 * | 4/2005 | Moore | 108/147 |
| 6,935,250 | B1 * | 8/2005 | Arnold | 108/147 |
| 6,997,116 | B2 * | 2/2006 | George et al. | 108/147 |
| 7,182,323 | B2 | 2/2007 | Muller | |
| 7,246,779 | B2 | 7/2007 | Doyle | |
| 7,306,192 | B2 * | 12/2007 | Sopp | 248/404 |
| 7,383,786 | B2 * | 6/2008 | Giannasca | 114/343 |
| 7,398,738 | B2 * | 7/2008 | Newhouse et al. | 108/147 |
| 7,908,981 | B2 * | 3/2011 | Agee | 108/147 |
| 8,015,914 | B2 * | 9/2011 | Huang | 92/165 PR |
| 2006/0272497 | A1 * | 12/2006 | Adams | 92/109 |
| 2007/0137535 | A1 * | 6/2007 | Jones et al. | 108/147 |
| 2008/0245279 | A1 * | 10/2008 | Pan | 108/144.11 |
| 2011/0203496 | A1 * | 8/2011 | Garneau et al. | 108/147 |

* cited by examiner

*Primary Examiner* — Darnell Jayne
*Assistant Examiner* — Daniel Rohrhoff
(74) *Attorney, Agent, or Firm* — Thomas M. Freiburger

(57) ABSTRACT

An adjustable table is easily moved from coffee table height to dining table. The weight of the table top is supported by a pneumatic cylinder, preferably exerting a force slightly greater than the weight of the table top. The cylinder connects to a much larger air tank, so that essentially constant lifting force is exerted. For stability of the table top a guide mechanism firmly retains the table against rotation, side movement or tilting. A unique locking mechanism retains the table at a selected height and is easily released with a finger lever.

13 Claims, 6 Drawing Sheets

PNEUMATIC ADJUSTABLE-HEIGHT TABLE

This application claims benefit from provisional application Ser. No. 60/984,668, filed Nov. 1, 2007.

BACKGROUND OF THE INVENTION

The present invention relates to a design of a table which serves multiple purposes as a coffee table and/or dinner table. For this purpose the table is vertically adjustable from a low coffee table height, such as 18 inches, continuously up to a dining table height, such as 29 inches. Other height ranges can also be encompassed, such as a table height for standing use.

In the majority of motor homes and other recreational vehicles currently produced the design focus is on providing a social gathering area which must double as a dining area because of limited space. This gives rise to the need for a table which can serve the dual purpose of a coffee table and a dining table. The present invention addresses this need by providing a table that can be easily raised from coffee table height to dining table height.

Other areas where this present invention is useful are in efficiency and studio apartments and in boats where space is also at a premium. Still other potential areas of use are in child care and elder care where a table easily adjustable can satisfy the need for a specific height.

Prior art includes several designs intended to fill this need. Although these designs currently on the market can fill the basic requirement of coffee table height and dining table height, they are universally difficult to change from one height to another and are generally limited to two specific predetermined heights. They continue to generate dissatisfaction among those who use them. Most require skill and/or physical strength to change the subject table from one height to another height.

The following patents have some relevance to adjustable-height tables or other adjustable-height devices: U.S. Pat. Nos. 7,246,779, 7,182,323, 6,997,116, 6,874,432, 6,840,582, 6,578,501, 6,571,720, 6,536,357, 6,435,110, 6,378,671, 6,343,556, 6,283,047, 6,227,357, 6,101,956, 5,553,550, 5,513,825, 5,438,939, 5,322,025, 5,313,892, 5,197,393, 4,436,007, 3,710,735 and 3,080,835. Of these patents, U.S. Pat. No. 6,283,047 discloses an adjustable-height table that can work on a pneumatic principle, i.e. an air spring. In the principal embodiment a double pivot is involved, with the table top swung upward or downward on an arm, thus displacing the horizontal position of the table as it is raised or lowered. In a second embodiment the movement of the table top is vertical, with a "bellows cylinder" or bellows type spring acting against gravity exerted on the table top and associated frame. A reservoir separate from the bellows cylinder is included. That table did not provide for a guiding assembly to provide stability of the table against lateral, tipping or rotating motion, through all the range of height adjustment, as in the present invention described below. Moreover, that patent involved a separate and spaced apart air reservoir connected by a fluid line to the pneumatic cylinder or bellows cylinder that exerted upward force on the table top.

U.S. Pat. No. 7,182,323 also employs a type of pneumatic spring, but in a much different arrangement from that of the present invention. Several of the other patents in the above list employ mechanical lifting devices, motorized or hand-rotated. Some use hydraulic cylinders, not necessarily for table tops as in the current invention.

SUMMARY OF THE INVENTION

In its several embodiments this invention is a system which includes a base designed to rest on the floor or other supporting surface, a table top and a relatively frictionless means to raise and guide the table top from a coffee table height, such as 18 inches, to a dining table height, such as 29 inches. Other possible height ranges include table height to a height appropriate for standing. A means is also included to provide a lifting force sufficient to support slightly more than the weight of the table top assembly, preferably with a net light lifting force. This lifting force is such that little or no effort is required from the user to raise the table and only light downward pressure is required to return the table to a lower position. A means of locking and unlocking the vertical movement of the table in an infinite plurality of vertical positions is also included. A relatively frictionless guiding mechanism maintains vertical alignment and a stable relationship between the table top and the base.

In the preferred embodiment frictionless linear bearings sliding vertically on one or more suitable shafts provide the required guidance and stabilization and one or more air cylinders connected to one or more pressurized air reservoirs provide a lifting force. A further aspect of the preferred embodiment uses a large sealed tubular tank member into which an air cylinder is directly mounted with the rod end of the cylinder projecting out of the tank. The tank end is sealed around the body of the air cylinder by means such as multiple o-rings and the air cylinder is held in place, preferably down in the tank so as to be integral with the tank, by means of a suitable bracket fastened securely to the tank. The rod end of the air cylinder is open to the atmosphere and the other end is in and open to the interior of the tank. This end of the air cylinder is therefore pressurized to the amount of pressure established in the tank. A suitable means, such as an automotive type air valve assembly, is provided for introducing air into the tank to bring the pressure to the desired amount. The integral mounting of the air cylinder into the tank eliminates numerous pipe fittings and pipes and/or hoses which would otherwise be required to connect the cylinder to the tank to form a closed system as taught by Haller in U.S. Pat. No. 6,283,047. The benefits include reduced chances of air leakage and reduced manufacturing costs.

The preferably integral air tank and air cylinder assembly is mounted in such fashion as to oppose the downward weight force of the table top assembly. When the cylinder rod is pushed back into the cylinder air is returned to the tank maintaining the pressure and therefore no external air pressure source is required once the tank has been charged to the required pressure. Since the combined volume of the air cylinder and the tank is substantially greater than the displacement volume generated by the air cylinder movement (in a ratio such as at least about 4 or 5 to 1), the lifting force applied to the table top by the air cylinder remains essentially constant (in contrast, U.S. Pat. No. 7,182,323 described above allows a 2 to 1 tank to cylinder ratio, which would not provide an essentially constant lifting force). As a result the air system can be pressurized to a pressure slightly higher than the pressure required to raise the table top assembly to its full height without external assistance when the locking mechanism is released, but still require only a light downward external force applied to the table top with the locking mechanism released to lower the table to the coffee table configuration or an intermediate level.

This type of integrated modular tank and air cylinder unit, especially in the integrated form described, has in any other potential applications essentially constant force without external power or air source connections as needed in a self contained unit.

Another feature of the preferred embodiment of the present invention is the design of the locking mechanism which allows for an infinite number of vertical height positions at which the table top assembly can be set and locked in place. This locking mechanism is actuated by a bell crank pivotally mounted to the upper table top assembly with its horizontal arm preferably recessed into the underside of the table top in a narrow slot such that it can be easily moved by upward finger pressure but not by accidental pressure from a person's knee, etc. The end of this arm is conveniently located near the edge under the table top. The other, vertical arm of the bell crank locking mechanism depends downwardly and is positioned to release the locking mechanism allowing free vertical table top movement when the horizontal arm is raised. This locking mechanism consists of a body which contains a slot through which one of the supporting shafts passes and which contains two eccentric circular clamping units brought to bear on the subject supporting shaft by a spring. The clamping units or cam lock units are arranged in an opposed or up/down mirror image fashion so that one is made to tighten with upward motion while the other clamps tighter with downward motion. As a result, until released, the subject shaft cannot move in either direction until released by the bell crank mechanism. This design of clamp has many potential applications wherever two-directional infinitely adjustable clamping is needed.

Also in the preferred embodiment of the invention the air cylinder or cylinders are oriented to provide the lifting force by upward cylinder rod extension. By this orientation cylinder rod seals are eliminated from the sealed pressurized system and rod seal leakage cannot affect the pressurization of the system. Since in this orientation the rod end of the cylinder or cylinders face upward and the upper end of the cylinder or cylinders are left open to the atmosphere, appropriate lubrication can be introduced into the open port on the rod end. Also in this embodiment of the invention a plug having a hole of appropriate size drilled through it is inserted into the open port on the rod end to control the rate of air flow in and out of the atmospheric end of the air cylinder or cylinders and thus to control the rate of vertical movement of the table top assembly.

Additionally in the preferred embodiment of the invention a shroud system consisting of upper and lower telescoping sheet metal members hide the mechanism between the table top assembly and the base assembly for aesthetic reasons.

In other embodiments of the invention a sealed tank or bladder unit or units can be substituted for the integrated modular tank employed in the preferred embodiment to supply air pressure to the air cylinder or cylinders. These and other objects, advantages and features of the invention will be apparent from the following description of a preferred embodiment, considered along with the accompanying drawings.

DESCRIPTION OF PREFERRED EMBODIMENTS

Figure 1:
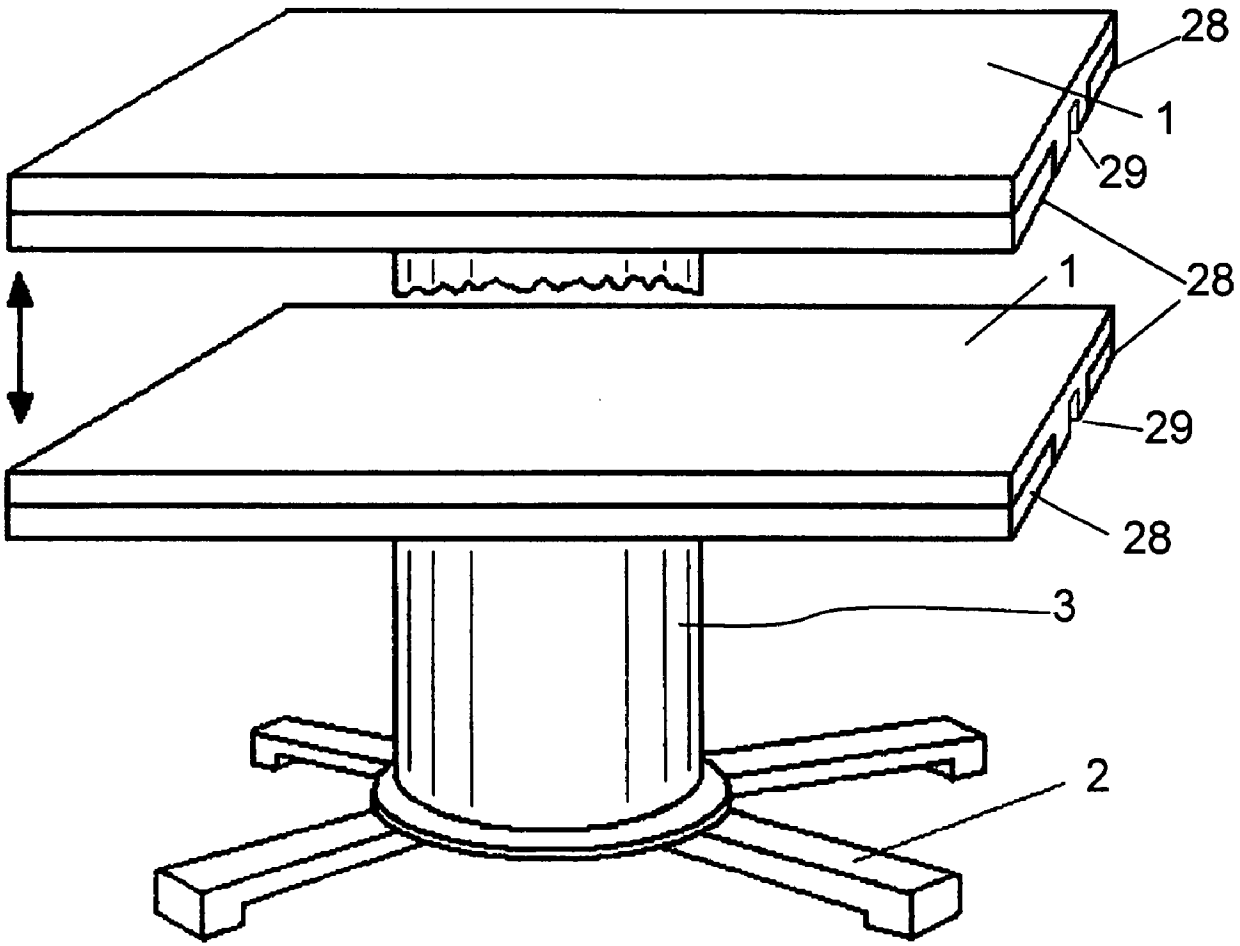
FIG. 1 is a drawing showing the present invention, a pneumatically adjustable height table, illustrating the table in two vertical positions.

The present invention provides a convenient system for raising a table top 1 as shown in FIG. 1 from a low position such as an 18 inch coffee table height to a higher position such as a 29 inch dining table height (or with other height limits), relative to a mounting base 2, by means of a pneumatic system enclosed for cosmetic purposes in a shroud assembly consisting of two telescoping parts 3. Only the outer shroud component 3 is seen in FIG. 1; an inner component can extend upward from the base 2, just inside the illustrated component 3, which is secured to and moves with the table. FIG. 1 also shows that the base 2 includes a floor-engaging pedestal. The base 2 is removable from the base plate 19 seen in FIG. 2 and interchangeable via several bolts (not shown) to a different style or configuration or material of floor-engaging element.

Figure 2:
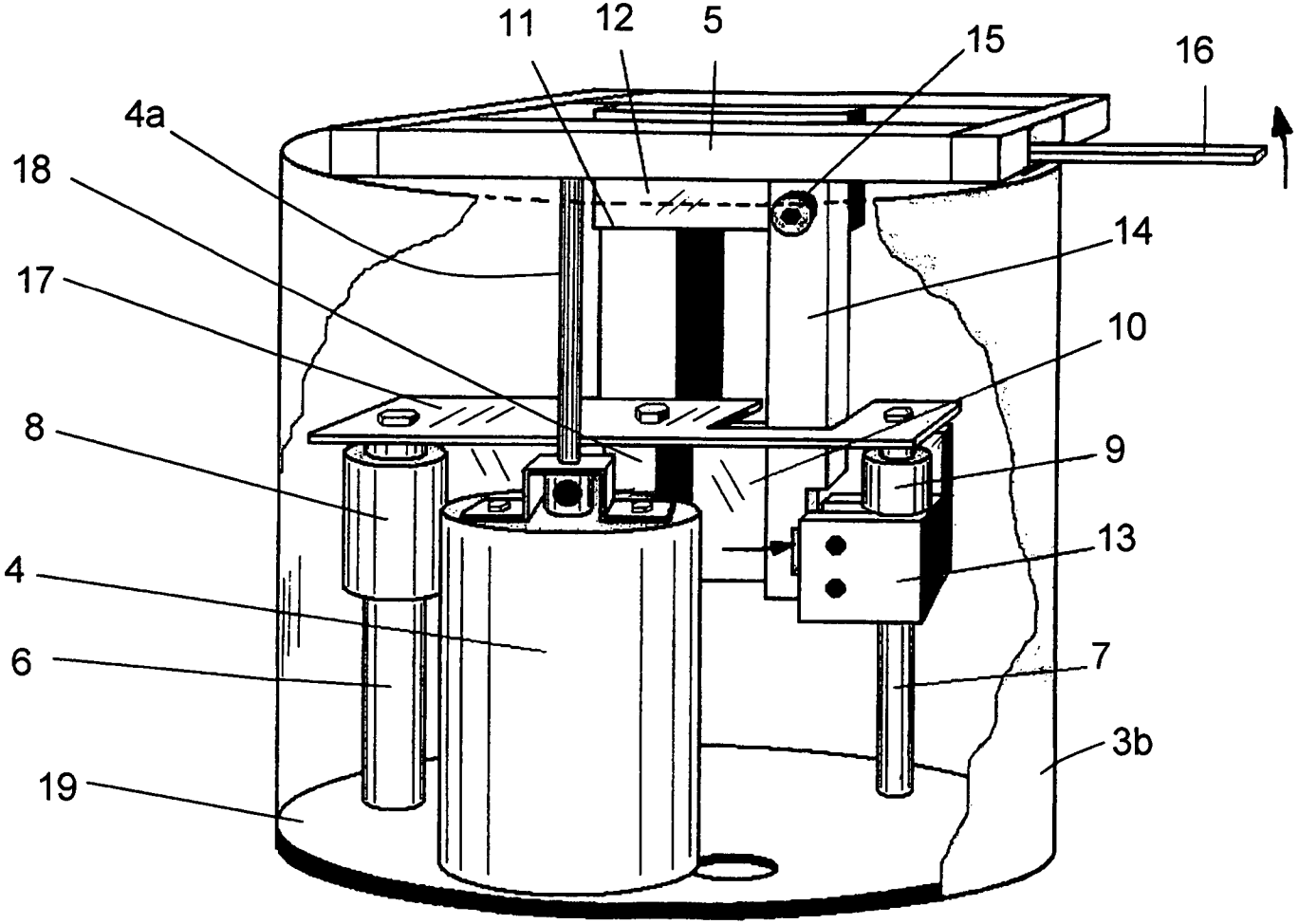
FIG. 2 is a drawing showing the present invention, a pneumatically adjustable height table, illustrating in a cutaway view format the various parts and features of the present invention in its preferred embodiment.
Figure 2A:
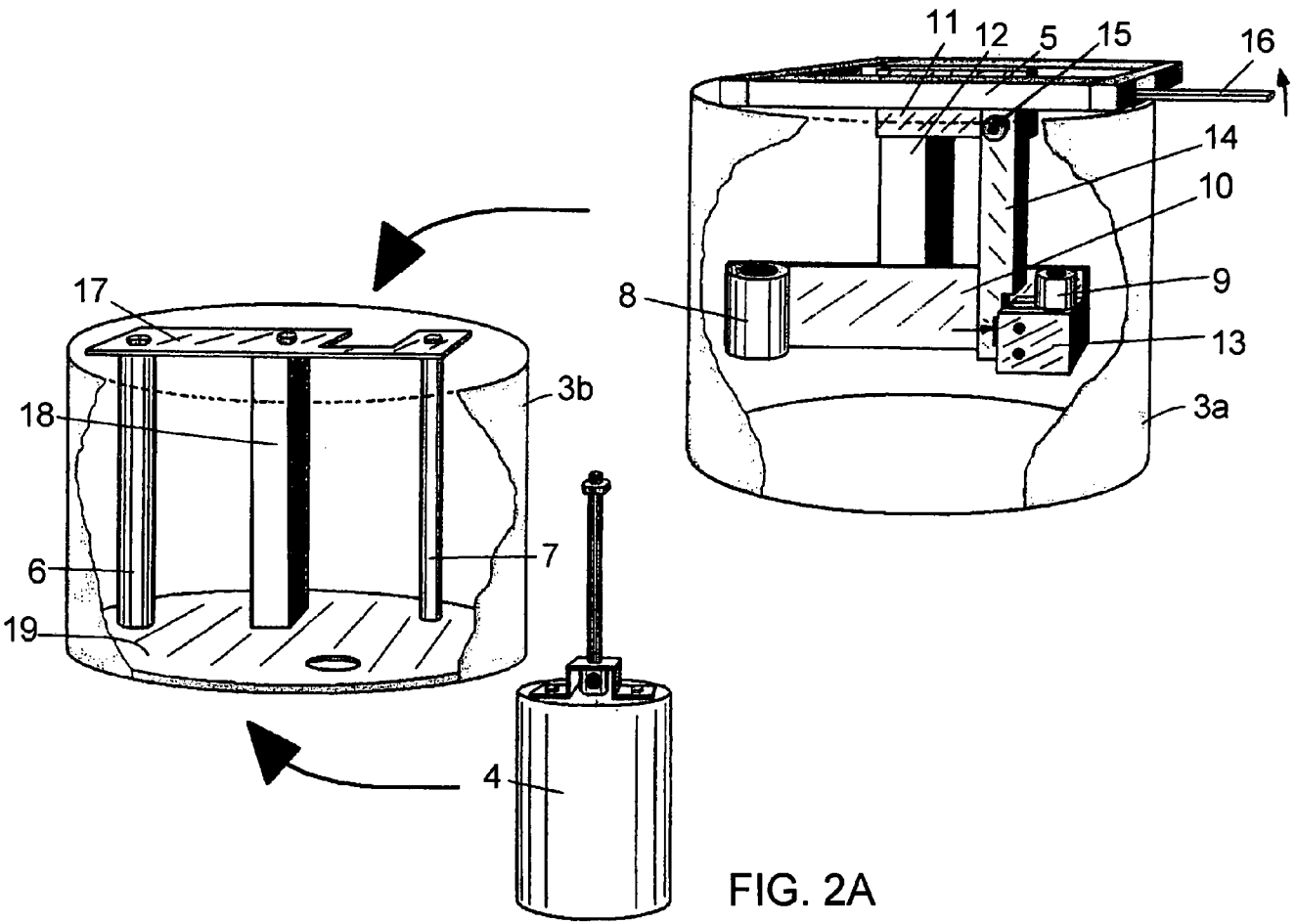
FIG. 2A is a drawing showing the present invention, a pneumatically adjustable height table, illustrating the same parts and features shown in FIG. 2, but in an exploded view format.

As shown in FIG. 2 and in exploded view FIG. 2A, the invention embodies a system in which an integrated air cylinder and tank assembly 4 supplies a substantially vertical force to a table support frame 5 to counteract the gravitational force exerted on the table top surface 1 and in which substantially frictionless guiding means 8 and 9 (with essentially frictionless linear bearings, not shown) running on vertical shafts 6 and 7 stabilize the vertical movement of the subject table top surface 1 relative to the mounting base 2 or other mounting device. At least one such vertical shaft 6, 7 is provided, more preferably two. Vertical support members 10, 11 and 12 join the frictionless guide assembly 8 and 9 to the top frame 5. FIG. 2A more clearly shows this upper assembly and indicates the outer shroud component 3*a* that is secured to the table top from 5 and fits over the base shroud component 3*b*. FIG. 2A also shows that the unit 4 can be removed from the base unit (as by several bolts, not shown). The unit has a cylinder rod 4*a* that engages the table top frame; it need not be secured to the table top but can merely bear upwardly against it.

FIG. 2A also shows, as part of the base components shown on the left, a stabilizing, structural member 17, which can be a generally horizontal bar or plate as illustrated. This can be firmly anchored by a generally vertical anchoring pedestal or post 18 secured to a base plate 19. As an alternative, the bar 17 could be anchored to the wall of the base shroud component 3*b*, in one or two places, to firmly stabilize the vertical shaft or shafts (6, 7). Any appropriate form of bracing could be used for stabilizing the upper end of the vertical shaft or shafts.

Figure 5:
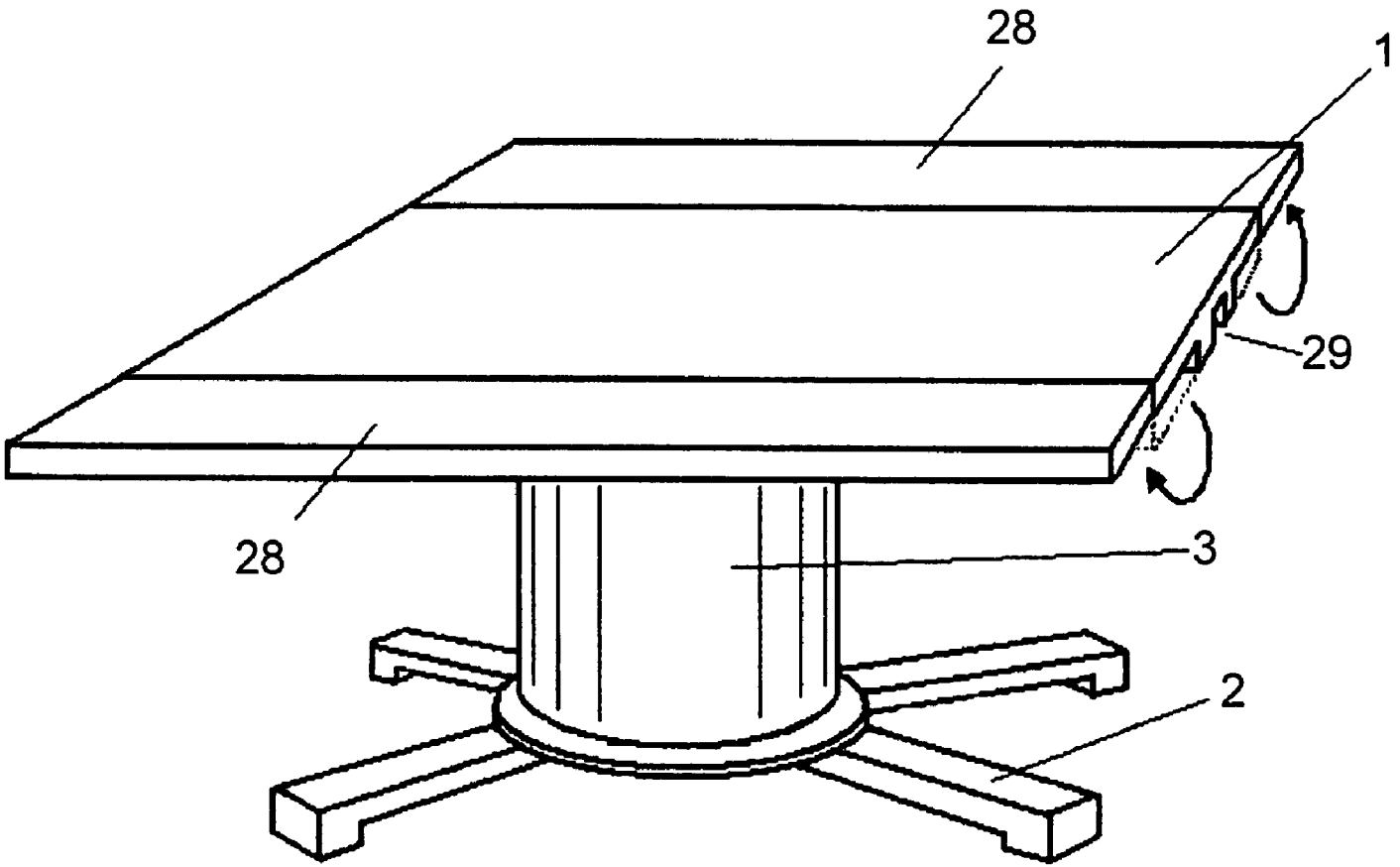
FIG. 5 is a drawing showing the drop leaves used in the preferred embodiment of the present invention in their fully opened, extended position.

A further element of the preferred embodiment of the invention is a clamping unit 13 mounted on the support member 10 and which clamps onto the guide shaft 7 until released by the vertical arm 14 of a bell crank assembly 14, 16 (pivotally mounted by a shoulder bolt 15) when upward finger pressure is applied to the distal end of the horizontal lever 16 within the notch 29 in the edge of the table top 1 illustrated in FIG. 1 and FIG. 5.

Figure 3:
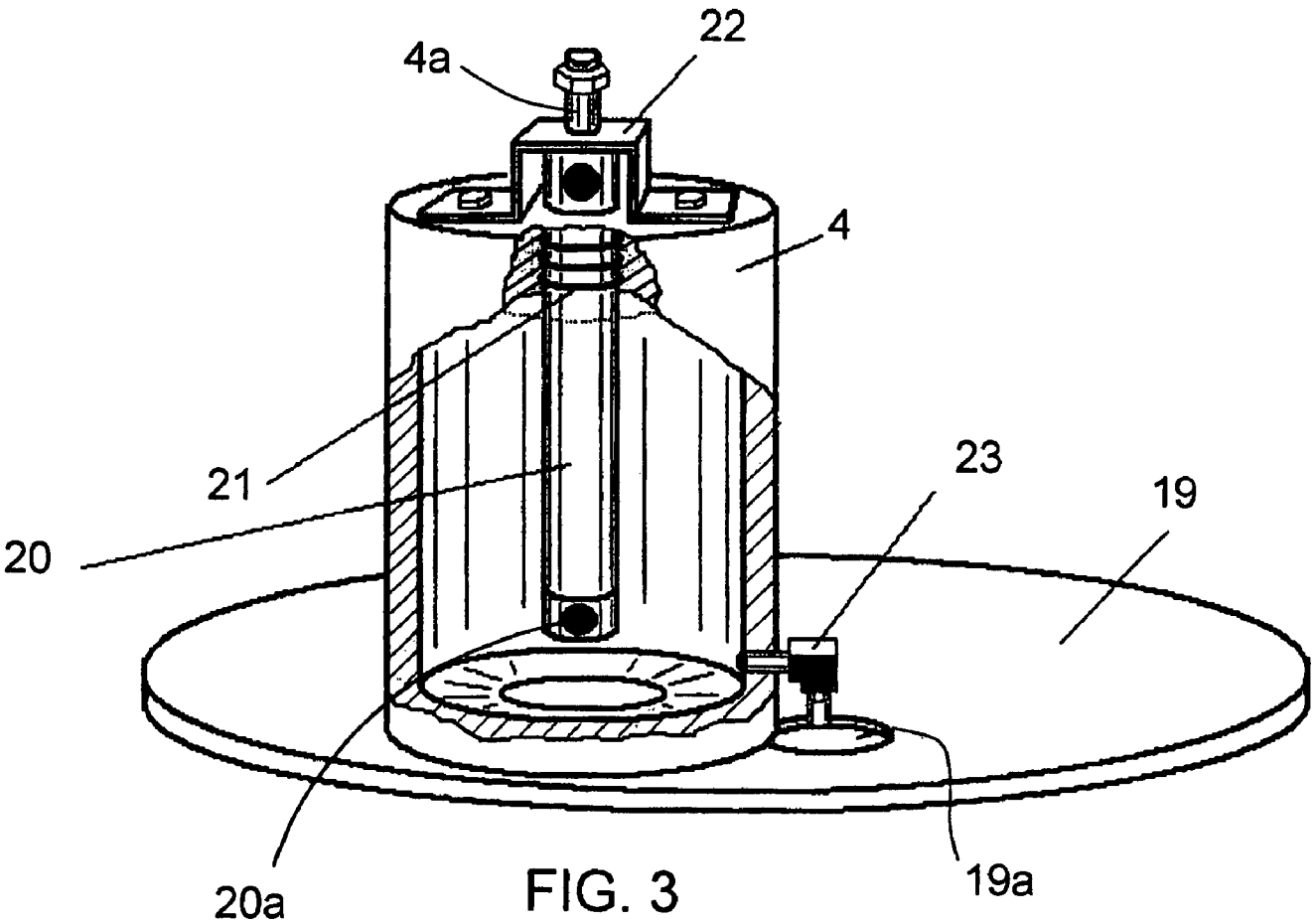
FIG. 3 is a cut away drawing the integrated air tank and cylinder unit used in the preferred embodiment of the present invention, with FIGS. 4B and 4C omitting a spring, for clarity.

An important element of the preferred embodiment of the invention is the integrated air cylinder and tank assembly 4 shown in detail in the cut away drawing of FIGS. 2 and 3 in the exploded view of FIG. 2A. The top of the air reservoir or tank 4 is fitted with O-rings 21 that form a static air tight seal around the body of the air cylinder 20 (other types of seal could be provided here). A bracket 22 holds the air cylinder 20 securely in place in the air tank 4. An air inlet fitting 23 provides an accessible means of pressurizing the air tank 4 and the air cylinder 20, with an air tight seal. Communication between the cylinder's displacement volume and the volume of the tank 4 is provided by an opening 20*a*, avoiding the need for tubes and fittings to connect the cylinder and tank. No such fittings are needed on either end of the cylinder in this implementation; the upper end, above the piston, is open to the atmosphere. Due to the fact that movement of the piston (not shown) and piston rod in the air cylinder 20 as the table top 1 is raised or lowered displaces only a small volume of air compared to the much larger volume of the air tank 4, the air pressure remains essentially constant in both the tank 4 and the air cylinder 20 and therefore the vertical force exerted upward on the table top 1 also remains essentially constant throughout vertical adjustments. Additionally, since as the table top 1 is lowered, the air used in the air cylinder 20 to raise it is returned into the air tank 4, the air pressure charge in it is essentially permanent. In the event that a change in the air cylinder 20 lifting force is desired, air pressure in the tank 4 can easily be altered using the air inlet fitting 23 accessed through a hole provided 12*a* in the base plate 19.

Air is mentioned as the preferred gas for charging the cylinder and tank, but other gases could be used if desired.

Note that the pneumatic cylinder and its relationship to the tank 4 need not be precisely as shown and described above. The cylinder 20 could be threadedly fitted into the top of the tank, with a thread seal. In another form the top portion of the tank 4 could be thickened or it could have a cylindrical collar that itself forms a cylinder wall in which the piston moves up/down. The piston could be long and with a lower end that simply extends down into the tank beyond the end of the cylinder above. All of these configurations are to be understood as within the invention, and within the meaning of "cylinder" in the claims.

Figure 4C:
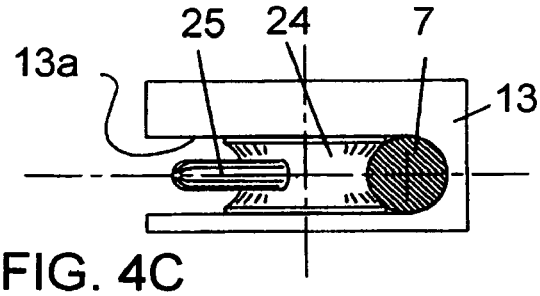
FIGS. 4A, 4B and 4C are front, side and top views showing the infinitely adjustable clamping system used in the preferred embodiment of the invention, with FIGS. 4B and 4C omitting a spring, for clarity.
Figure 4B:
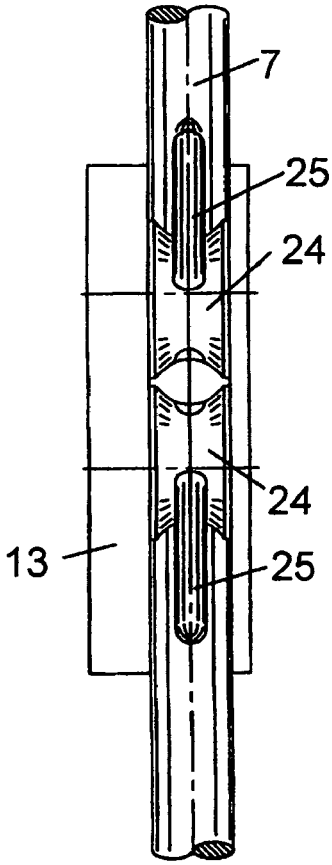
Figure 4A:
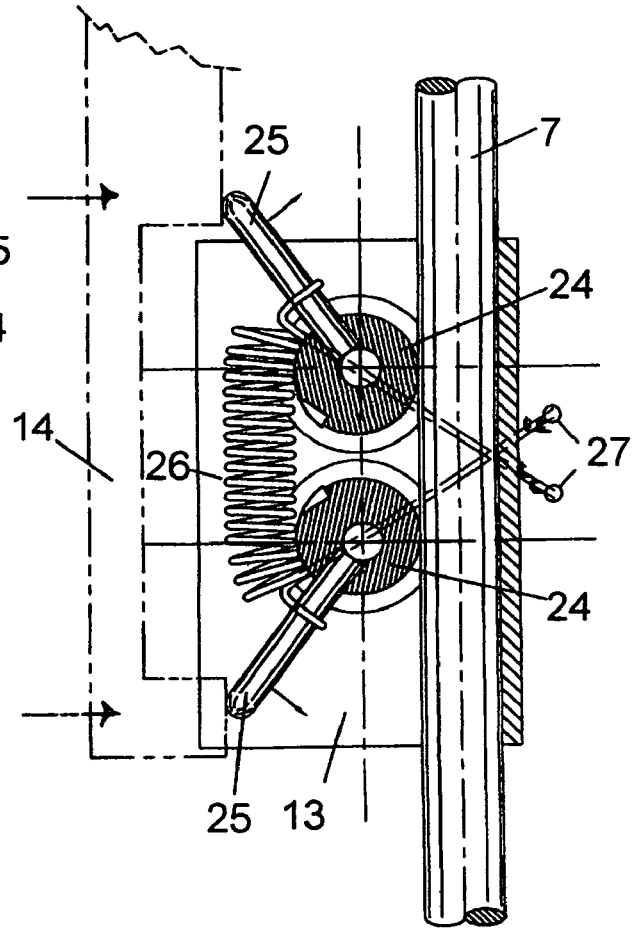

The clamping unit 13 is an essential element of the preferred embodiment of the invention. FIGS. 4A-4C show the details of its function and design. The body part of the clamping unit 13 contains a slot 13*a* configured to fit loosely around the guide shaft 7, as best seen in FIG. 4C. This slot also contains two curved cam devices 24 made in a round spool shape pivotally mounted off center as indicated at 27. Two pin members or cam levers 25 are securely mounted into the cam devices 24, fixed to the cams. Each end of a tension spring 26 is hooked over one of the pins or levers 25. The spring 26 pulls on the lower pin 25 causing the lower cam 24 to rotate clockwise which, due to its off-center pivotal mounting, causes it to press against the guide shaft 7 to be forced back against the bottom of the slot 13*a* in the clamp body 13. Also any downward relative movement of the guide shaft 7 tends to turn the lower cam 24 in the same clockwise locking direction, tightening the grip on the guide shaft 7. In similar fashion, the upper cam device 24 is turned counterclockwise by the spring 26 causing it to force the guide shaft 7 back against the bottom of the slot in clamping unit 13; and further, any relative upward movement of the guide shaft 7 will cause the cam device 24 to turn counterclockwise further tightening the grip on the guide shaft 7. Therefore, once the spring 26 has tightened the two cam devices 24, the clamping unit 13 is locked in place and unable to be moved either up or down relative to the vertical shaft 7. Since the clamp body 13 is securely mounted to the upper table top support members 10, 11 and 12 as shown in FIG. 2 and in exploded view FIG. 2A, this clamping action effectively locks the table top in position until the clamping action is released. This is done by movement of the bell crank 14, 16. This release is accomplished by the action of the lower end of the generally vertical depending arm 14 of the bell crank, pressing both pins 25 toward guide shaft 7. As soon as the pressure exerted by the bell crank arm 14 is released, the tension spring 26 reestablishes the clamping action and the table top is again locked in position at the new height.

Note that the cam devices 24 need not be fully circular but could only describe an arc or curve of sufficient length to perform the cam function.

A final element of the preferred embodiment of the present invention is the use of drop leaves 28 to increase the width of the table top 1, as shown in FIGS. 1 and 5. This allows the table in the mode with the drop leaves 28 folded under on both sides, as shown in FIG. 1, to be narrow enough to fit into the limited spaces available in cases such as a motor home with slideouts retracted. The use of special commercially available snap hinges allows the drop leaves 28 to tuck back under the table top 1 creating an esthetically pleasing and practical appearance in the narrow "coffee table" configuration as shown in FIG. 1 but to be instantly ready to be converted to its "dinner table" or "card table" configuration as shown in FIG. 5 with the drop leaves 28 open. The table top preferably is configured with recesses as seen in FIGS. 1 and 5 to receive the drop leaves 28 when folded under, to give an essentially uniform-thickness table edge as shown in FIG. 1.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. An adjustable-height table, comprising:

a base plate, a table top with a frame, positioned above the base plate, a single pneumatic cylinder connected to the base plate and with a cylinder rod extending from the cylinder and engaged with the table top frame so as to exert an upward pushing force on the table top when the pneumatic cylinder is charged with a gas, the single pneumatic cylinder being a sole means of lifting the table top, a guide assembly stabilizing the table top against lateral and tipping motion, including a plurality of shafts fixed to the base plate and extending upwardly, and a substantially frictionless slide member slidable vertically on each shaft as the table top is moved up or down relative to the base plate, the table top frame being secured to each of the slide members, the guide assembly further including a stabilizing structural member connected to a top end of each shaft and extending from the shaft generally horizontally and having a connection to the base plate, the shafts being spaced apart and extending upward from the base plate, and further including a generally vertical anchoring post secured to the stabilizing member and to the base plate, and wherein the stabilizing structural member comprises a structural bar extending between and connected to the tops of the shafts and the anchoring post, and a position locking mechanism connected to and operable between the table top and the base such that when the locking mechanism is released the table top can be moved up or down by a user, and when the locking mechanism is engaged the table top is fixed in position.

2. The table of claim 1, wherein the connection to the base plate comprises a generally vertical anchoring post secured to the stabilizing member and to the base plate.

3. An adjustable-height table, comprising:

a base, a table top with a frame, positioned above the base, a pneumatic cylinder connected to the base and with a cylinder rod extending from the cylinder and engaged with the table top frame so as to exert an upward pushing force on the table top when the pneumatic cylinder is charged with a gas, a guide assembly stabilizing the table top against lateral and tipping motion, including one or more vertical shafts fixed to the base and extending upwardly, and a substantially frictionless slide member slidable vertically on each shaft as the table top is moved up or down relative to the base, the table top frame being secured to each of the slide members, and a position locking mechanism connected to and operable between the table top and the base such that when the locking mechanism is released the table top can be moved up or down by a user, and when the locking mechanism is engaged the table top is fixed in position, the position locking mechanism including a bell crank pivotly attached on the table top frame, with a finger lever extending essentially horizontally and positioned under the table top surface so as to be accessible to a user, for pushing up manually on the finger lever to rotate the bell crank so as move the locking mechanism to the released position to allow the table top to be moved up or down, and the bell crank including a downwardly depending arm, and the locking mechanism including a cam connected to the table top frame and spring-biased to engage firmly against one said vertical shaft to latch the table top in place against vertical movement, and the depending arm of the bell crank being effective, when the finger lever is pushed up, to disengage the cam from the vertical shaft against the spring-bias.

4. An adjustable-height table, comprising:

a base, a table top with a frame, positioned above the base, a pneumatic cylinder connected to the base and with a cylinder rod extending from the cylinder and engaged with the table top frame so as to exert an upward pushing force on the table top when the pneumatic cylinder is charged with a gas, a guide assembly stabilizing the table top against lateral and tipping motion, including one or more vertical shafts fixed to the base and extending upwardly, and a substantially frictionless slide member slidable vertically on each shaft as the table top is moved up or down relative to the base, the table top frame being secured to each of the slide members, and a position locking mechanism connected to and operable between the table top and the base such that when the locking mechanism is released the table top can be moved up or down by a user, and when the locking mechanism is engaged the table top is fixed in position, wherein the position locking mechanism is connected to the table top frame and includes two opposed cams biased by a spring to engage firmly against one said vertical shaft, the two cams being spaced apart along said vertical shaft and operating in opposed directions of rotation, such that force on the table top in either vertical direction will cause one or the other of the cams to tend to rotate in and engage the shaft more tightly to thereby firmly lock the table top in place.

5. An adjustable-height table, comprising:

a base, a table top with a frame, positioned above the base, a single pneumatic cylinder connected to the base and with a cylinder rod extending from the cylinder and engaged with the table top frame so as to exert an upward pushing force on the table top when the pneumatic cylinder is charged with a gas, the pneumatic cylinder being a single-acting cylinder with an upper end open to atmosphere above a piston, and the pneumatic cylinder being a sole means of lifting the table top and being in a closed system which, once charged with air via an air inlet valve, is sealed with an essentially permanent charge of air that acts as a spring urging the table top upwardly without connection to any outside source of pressurization, a guide assembly stabilizing the table top against lateral and tipping motion, including one or more vertical shafts fixed to the base and extending upwardly, and a substantially frictionless slide member slidable vertically on each shaft as the table top is moved up or down relative to the base, the table top frame being secured to each of the slide members, and a position locking mechanism connected to and operable between the table top and the base such that when the locking mechanism is released the table top can be moved up or down by a user, and when the locking mechanism is engaged the table top is fixed in position.

6. The table of claim 5, wherein the pneumatic cylinder includes a gas displacement chamber, and further including a large gas pressure tank in said closed system, much larger than the cylinder's gas displacement chamber and connected in fluid communication with the cylinder's gas displacement chamber, such that when the table top is lowered or raised the lifting pressure on the table top from the pneumatic cylinder remains essentially constant.

7. The table of claim 6, wherein the pneumatic cylinder exerts an upward force greater than the weight of the table top, table top frame and cylinder rod, so that when the locking mechanism is released the table top tends to rise toward an upper limit position, requiring downward pushing to lower the table top.

8. The table of claim 6, wherein the gas pressure tank includes a gas fill fitting to allow tank pressure to be adjusted when desired.

9. The table of claim 6, wherein the large gas pressure tank has a volume at least about 4 times the volume of the cylinder's gas displacement chamber.

10. The table of claim 6, wherein the pneumatic cylinder has a lower end which is positioned within the large gas pressure tank, and the lower end having an opening to the gas displacement chamber of the cylinder, without gas fittings between the cylinder and tank.

11. The table of claim 5, further including a large gas pressure tank in said closed system, and wherein the pneumatic cylinder is built into the large gas pressure tank.

12. The table of claim 11, wherein the large gas pressure tank has a volume at least about 5 times a displacement volume of the cylinder.

13. The table of claim 5, wherein the base comprises a removable, interchangeable floor-engaging pedestal.

* * * * *